United States Patent [19]

Balkin

[11] Patent Number: 4,623,063

[45] Date of Patent: Nov. 18, 1986

[54] FIBREBOARD CONTAINER FOR COIL MATERIAL

[76] Inventor: Michael L. Balkin, 30160 Orchard Lake Rd., Ste. 150, Farmington Hills, Mich. 48018

[21] Appl. No.: 823,578

[22] Filed: Jan. 29, 1986

[51] Int. Cl.[4] ..... B65D 5/58; B65D 85/04

[52] U.S. Cl. ..... 206/408; 206/395; 206/397; 206/415; 242/137; 229/109

[58] Field of Search ..... 206/395, 397, 405, 406, 206/408, 415, 521; 242/137, 137.1, 138, 105, 129; 229/108, 109

[56] References Cited

U.S. PATENT DOCUMENTS

| | | | |
|---|---|---|---|
| 2,713,938 | 7/1955 | Snyder | 206/395 |
| 2,726,803 | 12/1955 | Ketler | 229/5.5 |
| 2,801,784 | 8/1957 | Blatt | 206/397 |
| 2,846,061 | 8/1958 | Wilke | 206/397 |
| 2,943,732 | 7/1960 | Kovaleski et al. | 242/129 |
| 3,333,685 | 8/1967 | Pezdek | 206/334 |
| 3,565,320 | 2/1971 | Osborne | 206/591 |
| 3,708,101 | 1/1973 | McDaniel | 206/521 |
| 4,122,949 | 10/1978 | Blatt | 206/408 |

*Primary Examiner*—William Price
*Assistant Examiner*—Brenda J. Ehrhardt
*Attorney, Agent, or Firm*—Cullen, Sloman, Cantor, Grauer, Scott and Rutherford

[57] ABSTRACT

A fibreboard shipping container for coil material, such as wire, is formed of an octagonal cross-section tubular body having a closed bottom and a cover, with an octagon shaped, tubular core coaxially positioned within the body. A pair of stiff, fibreboard panels are forcibly positioned within the container on opposite sides of the core in substantial face to face contact with their adjacent core wall surfaces, and with their opposite vertical edges pressing against their adjacent interior wall surfaces of the body. The panels have closely spaced, horizontal score lines for folding their lower edge portions incrementally upwardly to adjust their heights to correspond to the distance between the cover and the upper surface of the core so as to apply downwards pressure by the cover against the core. In addition, a stiff, fibreboard sheet whose outer periphery is octagonally shaped to correspond to the size and shape of the interior of the core is forced within the core for substantially continuous line contact between the peripheral edge of the sheet and the interior wall surfaces of the core to brace the core. The panels and the sheet lock the core and the coil against movement within the container and protect the core against deformation during transportation of and impacts to the container.

6 Claims, 5 Drawing Figures

FIBREBOARD CONTAINER FOR COIL MATERIAL

BACKGROUND OF INVENTION

This invention relates to drum-like, fibreboard containers which are generally octagonally tubular in shape, and contain similarly shaped cores, for receiving and transporting coil material, such as wire, rope, line and the like. Examples of such a container are disclosed in U.S. Pat. No. 2,565,188 issued Aug. 21, 1951 to Welshenbach and U.S. Pat. No. 4,134,531 issued Jan. 16, 1979 to Martenez. Cores of the type contemplated here are illustrated, for example, in U.S. Pat. No. 2,943,732 issued Apr. 9, 1956 to Kovaleski.

In such types of containers, stiff, heavy fibreboard or containerboard is multiply folded into a polygonally shaped tube to form the outer container drum. The bottom may be formed out of the same sheet or may be formed out of a separate folded sheet. Likewise, a cover suitably folded out of similar board, provides a closure. The core, which is coaxial with the container, forms an annular space in this container that facilitates the winding and unwinding of coil material into and out of the drum and keeps the coil in position during transportation.

In such containers, since the size of the coil and the amount of material within a particular coil vary, a typical coil is relatively loose within the container. That is, during transportation of the container, such as by truck or by rail or by internal plant moving equipment, the coils tend to shift somewhat. This may affect their relatively smooth curvatures and tends to tangle the coiled material during the unwinding or pay-off of the coil. This can cause damage to the material and time delays in unwinding. Hence, it is desirable to have some means for locking the coil relative to the container and also to lock the container core so that it does not deform or shift position during movement of the container or during impacts.

However, since the containers are relatively inexpensive and it is necessary to handle them with minimal labor and preferably, without separate tools, it has been difficult to devise a system for immobilizing the coil relative to the container. The invention herein relates to such a system.

SUMMARY OF THE INVENTION

This invention contemplates immobilizing the coil within the octagonally shaped shipping container and simultaneously immobilizing and protecting the octagonally shaped core within the container bymeans of inserting a pair of stiff fibreboard panels on opposite sides of the core, in face to face contact with the core walls, and with the opposite ends of the panels jammed against the interior wall surfaces of the container. The panels press downwardly against the coil and are held in position by the cover. To insure that the height of each panel corresponds to the space between the upper surface of the coil and the lower surface of the cover, the panels are scored horizontally so that they may be folded upwardly along their bottom edges for height adjustment.

Additionally, a stiff, fibreboard sheet which is octagonally shaped is pressed into the center of the core for line contact with the core interior wall surfaces so as to brace the core transversely near the upper portion of the coil. Consequently, the panels and the sheet cooperate to lock the coil and the core against movement within the container, insure uniform coil internal diameter, and avoid tangling during pay-off. This system is accomplished without the necessity of tools or any substantial labor. The additional parts, namely, the panels and sheet, are sufficiently inexpensive so as not to materially affect the overall cost of the container.

An object of the invention is to provide a simplified system, requiring no tools and little manual labor and only a very slight additional expense, for immobilizing a coil relative to the shipping container and simultaneously, to protect and immobilize the container core. The system protects the container and the coil against damage.

Other objects and advantages of this invention will become apparent upon reading the following description, of which the attached drawings form a part.

DETAILED DESCRIPTION

Figure 1:
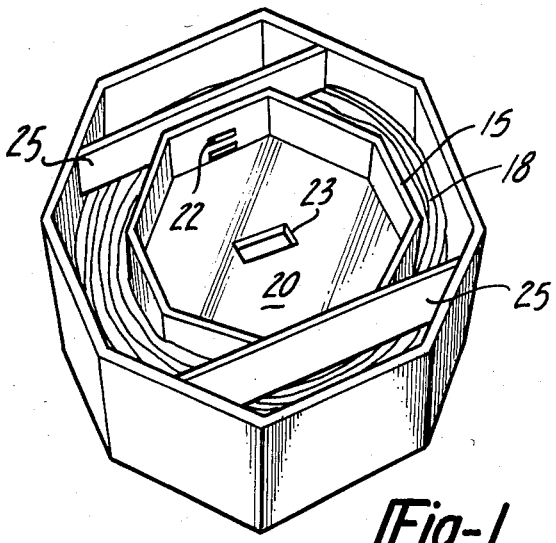
FIG. 1 is a perspective view looking down into the container, with its cover removed.

As illustrated in the drawings, the container is formed of an octagonal cross-sectional shaped, tubular drum 10 having a closed bottom 11 and a removable cover 12. These parts are made of heavy, stiff, substantially rigid fibreboard folded into the respective shapes. An example of forming the fibreboard and folding it to produce the desired octagonal shape, that is, with the eight side wall sections, is disclosed in the above-mentioned U.S. Pat. No. 2,565,188 issued Aug. 21, 1951 to Welshenbach. Since the folding and cut shapes of the parts are not material to the invention, the details thereof are omitted.

The core 15 is also octagonally shaped in cross-section. The core need not be as high as the container or external tubular drum, but it is of the same cross-sectional shape except for the smaller size. The core may have outwardly extending tabs 16 bent from its lower edges for fastening it to the bottom 11 of the container. Such tabs may be adhesively secured or secured with staples or the like fasteners to the closed bottom 11. Alternatively, the tube may fit loosely without fasteners, and span the space between the core and the container wall. If desired, a flat, washer-like collar, which is shaped to closely fit within the container and around the core, may be inserted over the tabs.

Figure 4:
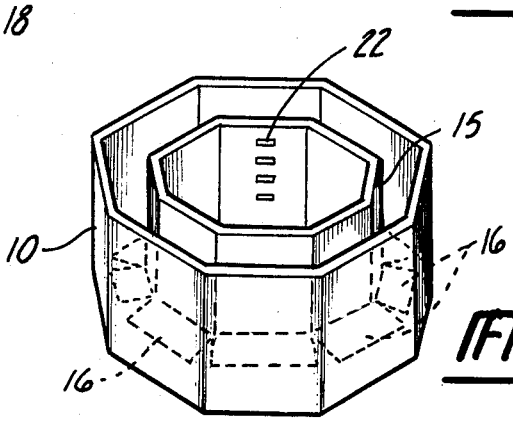
FIG. 4 is a perspective, top-front view of the open container and core.

When the container and insert are assembled as shown in FIG. 4, a pre-formed coil 18 may be loaded into the annular space around the core or wire-like material be payed in to form the coil in the container. The coil may be of wire, rope, or other types of material which are normally transported and handled in coil form.

Figure 2:
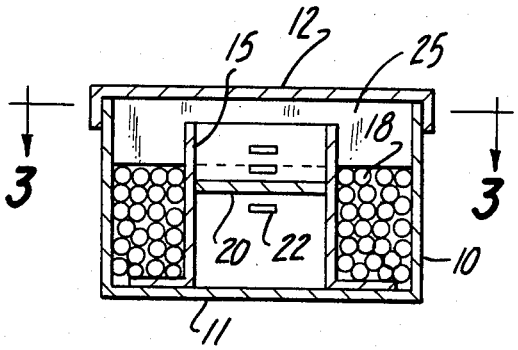
FIG. 2 is a cross-sectional view, to a smaller scale, of the container carrying a coil.
Figure 3:
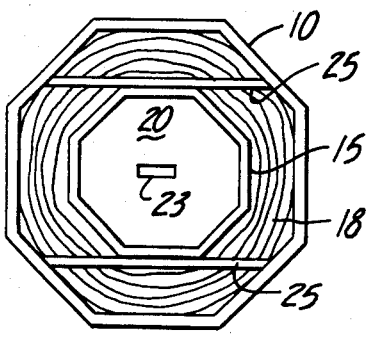
FIG. 3 is a top, plan view, taken in the direction of arrows 3—3 of FIG. 2.

A flat, rigid or stiff fibreboard sheet 20 is formed with a peripheral shape corresponding to and of a size to tightly fit within the interior of the core. The sheet is provided with tabs 21 on at least one and preferably two or more of its edges for insertion into slots 22 formed in the walls of the core. A number of slots may be formed in opoposing walls so that the sheet may be located in a number of different positions relative to the height of the core. The sheet forms a brace for the interior of the core and preferably is located near, but below, the upper surface of the coil 18, as illustrated in FIG. 2. Because the sheet is preferably slightly oversized relative to the interior shape and size of the insert, it must be pushed in with considerable manual force. It may be pulled out or repositioned by grasping it through a large opening 23 which forms a gripping or handle means. The sheet may be scored across its middle (not illustrated) so the sheet may be bent to facilitate insertion.

After a coil is positioned within the annular space between the interior of the container wall and the exterior of the insert, the coil is clamped or compressed in place by means of adjustable height panels 25 which are formed of thick, stiff, rigid fibreboard. These panels which are in the shape of horizontally elongated rectangles, are provided with numerous score or slit lines 26 which extend horizontally across the width of the panels. A number of these score lines are provided, each vertically spaced above the preceding one.

Figure 5:
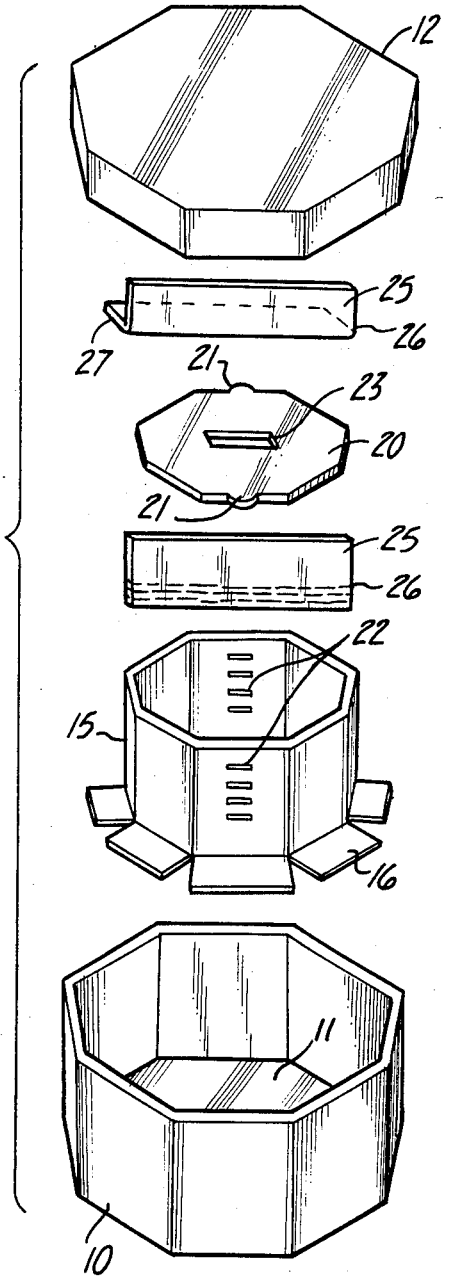
FIG. 5 is a perspective view of the container with the parts shown disassembled.

The panels, preferably used in pairs, are pushed downwardly into the container, with each in contact with the surface of the adjacent insert wall and with their vertical edges jammed tightly against the interior surface of their adjacent container wall section. In order to compensate for the varying height between the upper surface of the coil and the bottom of the cover, the lower edges of the panels may be bent upwardly along the score lines, as illustrated by the dotted line bent up edge 27 in FIG. 5.

By properly sizing the height of each of the panels, that is, by starting the bending of the lower edges of each of the panels so that as they are pushed downwardly against the coil, they bend sufficiently to cause the panel to fill the vertical space beneath the cover. The cover presses against the upper edge of the braces to apply a downward compressive force against the coil. Hence, the coil is wedged in place tightly due to the cover, as well as due to the panels being forced and held in place frictionally against the surfaces of the core and container. If desired, a washer-like, fibreboard collar may be fitted over the upper surface of the coil, i.e., covering the annular space between the container wall and insert. In that case, the panels press down against such collar to hold the coil.

In operation, the parts making up the container, cover, core, etc., are all die cut and shipped flat. The user sets up the container by folding the fibreboard into the desired shapes. After the core is assembled within the container, as shown in FIG. 4., the pre-formed coil is inserted or the coil is formed in the container. Thereafter, the sheet 20 is pushed into the core and the panels are pushed into the container and downwardly against the coil. Thereafter, the cover is applied and additional fastening means, such as shipping tape or the like is applied to hold the cover and container together.

The height of the container may vary considerably from less than a foot to a number of feet in height, depending upon the nature of the coil, its weight, etc. The panel height must be made sufficient to handle some variations in the general height of any particular type of coil. Preferably, sufficient slots are provided in the core walls to enable the position of bracing sheet to be adjusted for optimum effect to prevent deformation of, or movement of, the core during transportation, impacts, etc.

Having fully described an operative embodiment of this invention, I now claim:

1. In a container for transporting and storing coil material such as wire and the like comprising an octagonal shaped in cross-section tubular body formed of heavy fibreboard folded into flat wall sections to provide the octagonal shape, with a closed bottom and a corresponding octagonal shaped in cross-sectional tubular core formed of heavy fibreboard folded into flat wall sections to produce the octagonal shape, with the core being coaxially positioned within the body and extending upwardly from the closed bottom to form an annular space between the body and core for receiving a coil, the improvement comprising:

a pair of vertically arranged stiff fibreboard panels positioned within the annular space upon opposite sides of the core, with each panel arranged in face to face contact with its adjacent core wall section, and with the vertical edges at the opposite ends of each panel tightly jammed, in line contact, against their adjacent body wall sections, and with the horizontal, lower edge of the panel tightly pressed against the upper portion of a coil arranged within the container;

whereby the panels lock the coils in place, against shifting movement within the container, and simultaneously reinforce the core and hold the core against shifting during movements of, or impacts to, the container.

2. In a container as defined in claim 1, and including said container having a removable cover, and said panels being provided with a number of horizontally directed, vertically spaced apart score lines, with the lower portions of the panels being upwardly foldable about the score lines when the panels are pressed downwardly against the upper portion of the coil so as to adjust the height of the panels to substantially equal the vertical distance between the cover of the container and the coil, and the cover holding the panels against the coil.

3. In a container as defined in claim 2, and including a stiff, flat, fibreboard sheet cut into an octagonal shape of a size corresponding to the interior size and shape of the core, with said sheet being force fitted within the core parallel to, and at a distance remote from, the container bottom, to form a substantially continuous line contact between the peripheral edge of the sheet and the wall sections defining the core for uniformly bracing the core wall sections against deforming inwardly, that is, towards the center line of the container, and for cooperating with the panels to rigidify the core and secure it in its predetermined relationship with the container body.

4. In a container for coil material such as wire and the like comprising an octagonally shaped, in cross-section, tubular body formed of heavy fibreboard, with a closed bottom, and a corresponding octagonally shaped in cross section tubular core formed of heavy fibreboard folded into flat wall sections to make up the octagonal shape, with the core being coaxially positioned within the body and extending upwardly from the closed bottom to provide an annular space between the body and core for receiving a coil, the improvement comprising:

a stiff, flat fibreboard sheet cut into an octagonal shape of a size corresponding closely to the interior size and shape of the core, and with said sheet being force fitted within the core parallel to, and at a distance remote from, the container bottom, and providing a substantially continuous line contact between the peripheral edge of the sheet and the wall sections defining the core for uniformly bracing the core wall sections against deforming inwardly towards the center line of the container.

5. In a container as defined in claim 4, and including tabs formed integrally with and coplanar with the sheet and extending outwardly, away from the center line, of selected edge portions of the sheet;

and slots formed in selected positions within the wall sections defining the core for receiving said tabs for locking the sheet at preselected locations within the core.

6. In a container as defined in claim 5, and including at least one vertically arranged fibreboard panel arranged within the annular space, with the center portion of the panel arranged in face to face contact with its adjacent core wall section and with the vertical edges at the opposite ends of the panel pressed tightly, in line contact, against the adjacent wall portions defining the body, and with the horizontal, lower edge of the panel tightly positioned against the upper portion of a coil arranged within the container;

whereby the panel and sheet cooperate to hold the core and coil against movement within the container.

* * * * *